US009192972B2

(12) United States Patent
Wang et al.

(10) Patent No.: US 9,192,972 B2
(45) Date of Patent: Nov. 24, 2015

(54) FORMING METHOD AND FORMING DEVICE

(75) Inventors: Feizhou Wang, Osaka (JP); Tomoyasu Nakano, Osaka (JP); Akinori Inokuma, Osaka (JP); Jilong Yin, Osaka (JP); Terutomo Akai, Osaka (JP)

(73) Assignee: NAKATA MANUFACTURING CO., LTD., Osaka-shi (JP)

( * ) Notice: Subject to any disclaimer, the term of this patent is extended or adjusted under 35 U.S.C. 154(b) by 264 days.

(21) Appl. No.: 13/879,944

(22) PCT Filed: Feb. 24, 2011

(86) PCT No.: PCT/JP2011/054176

§ 371 (c)(1),
(2), (4) Date: Jul. 3, 2013

(87) PCT Pub. No.: WO2012/060116

PCT Pub. Date: May 10, 2012

(65) Prior Publication Data

US 2013/0298630 A1 Nov. 14, 2013

(30) Foreign Application Priority Data

Nov. 4, 2010 (JP) ..... 2010-247509

(51) Int. Cl.
*B21D 7/08* (2006.01)
*B21D 5/12* (2006.01)

(52) U.S. Cl.
CPC ... *B21D 7/08* (2013.01); *B21D 5/12* (2013.01)

(58) Field of Classification Search
CPC ..... B21D 7/08; B21D 5/06; B21D 5/10; B21D 5/12; B21C 37/08; B21C 37/0803; B21B 21/04
See application file for complete search history.

(56) References Cited

U.S. PATENT DOCUMENTS 1,980,308 A 11/1934 Adams, Jr.
3,145,758 A 8/1964 Sprung et al.
3,605,472 A * 9/1971 Akihiro Saito et al. ..... 72/176

FOREIGN PATENT DOCUMENTS

JP 55-51648 B2 12/1980
JP 62 114729 5/1987

(Continued)

OTHER PUBLICATIONS

International Search Report Issued Apr. 5, 2011 in PCT/JP11/54176 Filed Feb. 24, 2011.

(Continued)

*Primary Examiner* — Teresa M Ekiert
(74) *Attorney, Agent, or Firm* — Oblon, McClelland, Maier & Neustadt, L.L.P.

(57) ABSTRACT

An object of the present invention is to provide a forming method and a forming machine in which in forming e.g., a round steel pipe, predetermined forming can be performed with less additional deformation imparted to a workpiece without deteriorating the productivity of the conventional roll forming, thereby manufacturing a high-quality product with high dimension precision. To achieve this object, the present invention provides a forming method and a forming machine, which adopt a rotating unit which rotatably moves on an endless track a die train having dies with outwardly directed and swingable forming passes in a breakdown step at an early forming stage, and in which the forming pass of each die holds the edge of the workpiece to rotatably move the die by changing the die to a predetermined angle, thereby realizing bending, so that problems due to twisting onto forming rolls and high locally-caused contact stress can be greatly reduced.

12 Claims, 10 Drawing Sheets

(56) References Cited

FOREIGN PATENT DOCUMENTS

| | | |
|---|---|---|
| JP | 7 275953 | 10/1995 |
| JP | 2000 61535 | 2/2000 |
| WO | 2009 110372 | 9/2009 |

OTHER PUBLICATIONS

International Preliminary Report on Patentability issued May 10, 2013 in Patent Application No. PCT/JP2011/054176 filed on Feb. 24, 2011 (submitting English translation only).

* cited by examiner

FORMING METHOD AND FORMING DEVICE

TECHNICAL FIELD

The present invention relates to a forming method and a forming machine, which manufacture a round pipe from a coiled metal material and a sheet metal material having a predetermined length and, more particularly, to a forming method and a forming machine, which adopt a rotating unit which rotatably moves, on an endless track, a die train having dies with outwardly directed and swingable forming passes in a breakdown step at an early forming stage, and in which the forming pass of each die holds the edge of a workpiece to rotatably move the die by changing the die to a predetermined angle, thereby realizing bending, so that problems due to twisting onto forming rolls and high locally-caused contact stress can be greatly reduced.

BACKGROUND ART

To form a long metal product, roll forming and press forming are mainly used. In the press forming, a workpiece is basically subjected only to two-dimensional deformation in cross section, thereby easily obtaining high product dimension precision, with less additional deformation and residual stress; however, the equipment cost including dies is high, the productivity is low, and there is product length limitation.

In the roll forming, since the edge of a workpiece is hard to pass through a large number of forming roll stands, it is difficult to use a sheet material; however, continuous production using a coiled material is enabled, so that the product length limitation is less, the productivity is high, and the equipment cost is less expensive than the press forming. However, forming rolls as rotors cannot be large due to production ability and cost limitation, additional deformation occurs in a workpiece subjected to three-dimensional deformation typified by twisting thereof onto the rolls, and further, the resistance in the advancing direction is large due to the twisting, thereby making the necessary driving energy large. In addition, the circumferential speed difference in the contact region between the forming rolls and a workpiece is great; therefore, the surface quality becomes a problem often due to product damage caused by the relative slip between both. The contact region between the forming rolls and a workpiece is small, so that the surface pressure between both becomes higher, resulting in the rolls becoming significantly worn, together with the circumferential speed difference.

Typically, an electric resistance welded pipe is manufactured by, with the use of the forming rolls, being subjected to a pre-step of uncoiling a coiled material to supply it to a forming step, an early-stage forming step performed by breakdown rolls, cluster rolls, and fin pass rolls, a welding step of welding the opposite edges of the material at e.g., a high frequency, a sizing step of correcting circularity and straightness of the pipe, and a cutting step of cutting the manufactured pipe to a predetermined length.

For instance, in the breakdown step, as a forming method showing a forming process from a raw plate into a pipe, a roll flower showing an edge track process from a raw plate into a pipe, of an edge bending method in which a material edge track is a cycloid curve, a center bending method in which the track is an involute curve, a circular bending method, a forming method combining these, or a double bending method is appropriately selected; however, basically, a pair of upper and lower convex and concave rolls and side rolls are used to hold a workpiece from the inner and outer surfaces thereof, thereby forming it into a desired cross-sectional shape.

PRIOR ART DOCUMENTS

Patent Documents

Patent Document 1: U.S. Pat. No. 1,980,308
Patent Document 2: U.S. Pat. No. 3,145,758
Patent Document 3: Japanese Patent Application Publication (JP-B) No. 55-51648
Patent Document 4: WO 2009/110372

DISCLOSURE OF THE INVENTION

Problems to be Solved by the Invention

The pipe manufacturing process using rotor tools which are the forming rolls has high productivity, and in recent years, the technical development for roll replacement in a certain product's outside diameter range has been actively performed, thereby, at present, the manufacturing process has become a forming method having extremely high productivity. However, the demerit due to the use of the rotor tools has not been solved at all.

In forming a long metal material into a desired shape, to reduce the demerit of the rolls, the roll forming has been attempted to be combined with dies, shoes, belts, or the press forming often. For instance, Patent Document 1 shows an example of a forming machine in which a pair of connected dies each having dies with semi-circular passes connected and attached to an endless chain rotated on an elliptical track between a pair of sprockets so that the semi-circular passes are continuous are prepared, and the connected dies are horizontal so that the semi-circular passes are opposite with respect to a horizontal band-shaped raw plate.

As shown in FIGS. 2 and 3 in Patent Document 1, the forming machine has a merit that, like upper and lower, right and left, and convex and concave forming rolls which have been conventionally used, a workpiece in the gap between concave semi-circular passes and convex conical rolls in the concave semi-circular passes follows the surfaces of the semi-circular passes moved continuously and horizontally; however, due to the use of the conical rolls, the demerit has not been solved at all. In addition, the semi-circular passes of the connected dies have only one kind of arc shape, with the result that various pipe diameters cannot be formed without replacing the endless chain of the connected dies.

In Patent Document 2, from the viewpoint of incapable of contacting the upper and lower rolls and the side rolls onto a workpiece at all times in pipe manufacturing, in particular, in the breakdown step, the forming of the width's center of the material uses the conventional upper and lower forming rolls; however, the forming of both edges of the material uses an endless belt, in place of the side rolls, to set a three-dimensional endless track for subsequently raising the material horizontally. In addition, in place of the belt, a conveyor chain having continuous plate-shaped shoes on the surface thereof is also used. In the breakdown step, large forming stress is applied onto the track of the endless belt and the chain; however, with a workpiece which is not thin and does not have low strength, it is assumed to be difficult to hold the mechanical strength of the track, and further, various pipe diameters cannot be formed.

Patent Document 3 discloses a forming machine which continuously performs UO forming in which when a large-diameter pipe is formed, with the use of press dies, a sheet material is formed into U-shape and then into O-shape. This machine has two devices of a U-shape forming portion and an O-shape forming portion, in which the U-shape forming portion holds and rotatably drives an endless belt-like continuous punch die in which a large number of punch-type die pieces are connected via a chain and an endless belt-like continuous rotation die in which a large number of U-shaped die pieces are connected via a chain so that convex and concave portions thereof are engaged with each other on a desired track, and the O-shape forming portion holds and rotatably drives an endless belt-like continuous rotation die in which a large number of semi-circular die pieces are connected via a chain so that the semi-circular die pieces are opposite to each other to form a circle on a desired track.

In addition, JCO forming has been practically used in which the forming of a sheet material into J-shape by press dies is repeated, and then, the material is formed into C-shape and then into O-shape.

In UO forming and JCO forming for a large diameter of 400 mm or more, typically, the press pressure of a machine is extremely large; therefore, the machine is required to rotatably drive the large endless belt-like continuous rotation die and to apply the same pressure as the conventional press onto a material in a desired position of the endless track, thereby inevitably making the machine larger, and each die piece has only one kind of surface shape, with the result that, of course, various diameters cannot be formed.

On the other hand, in Patent Document 4, the present inventors have proposed a forming method and a forming machine based on quite a novel technical idea different from Patent Documents 1 to 3. The forming machine can substantially realize the use of, e.g., a large forming roller for forming by using an endless shoe block train in which a large number of shoe blocks with passes on their rotating curved faces are connected, the outwardly directed passes being continuously movable on an endless track, and by allowing the surface of the endless track in a forming segment which comes into contact with a workpiece to have the same curvature radius and length as a predetermined arc portion of an imaginary large-diameter circle.

The novel forming method and forming machine can be adopted in the breakdown step in pipe manufacturing, can greatly reduce the demerit of the forming rolls by maintaining continuity and high productivity which are the features of the conventional roll forming and, as in substantially the same manner as the press forming, can deform a workpiece in two dimensions. However, when the forming machine in the breakdown step is required to have a plurality sets of rotating units, which cannot be best in the equipment cost.

An object of the present invention is to provide a novel forming machine and forming method in which in forming a round pipe, a square pipe, and an open cross-section material, in particular, in an early- and middle-stage forming step corresponding to the conventional breakdown step, without deteriorating the productivity of the conventional roll forming, device replacement is enabled in a certain diameter range, and predetermined forming can be performed with less additional deformation imparted to a workpiece, thereby making a high-quality product with high dimension precision.

Means for Solving the Problems

The present inventors have eagerly studied the die shape and configuration, and the endless die train track configuration and rotating method, for the purpose of completing the breakdown step by using a pair of rotating units having the same endless die trains as proposed in Patent Document 4, and for the purpose of holding the edge of a workpiece from outside in the plate width direction for bending along the edge track in the roll flower of e.g., the circular bending method.

As a result, the present inventors have completed the present invention by finding that bending is enabled along the edge track defined by the roll flower of the desired one selected from the known conventional roll forming methods, by forming a die block train in which the pass of each die has an L-shaped cross section so as to be abutted onto the edge of the workpiece from outside in the plate width direction, in particular, onto the end surface thereof, and the die itself is rotated on an endless track in such a manner that the abutment angle of the outwardly directed pass is changeable, and by changing the abutment angle of the die train according to an angle control mechanism which can change the swing angle at e.g., a predetermined change rate when the die is continuously moved on a straight track, e.g., according to a following track provided along with the straight track.

That is, the present invention provides a forming machine and a forming method in which a rotating unit is provided which can rotatably move on an endless track a die train in which a plurality of dies with outwardly directed and swingable forming passes are connected in a rotating direction to form an endless train, and including an angle control mechanism which changes and holds a swing angle of the forming pass of each of the dies, wherein a straight or substantially straight track segment having a predetermined length in which a pair of rotating units are opposite to enable a workpiece to enter into between the opposite forming passes, and the forming passes continuously hold both edges in the width direction of the workpiece to be moved therewith is a forming segment, wherein while the workpiece passes through the forming segment, the angle control mechanism follows a following track provided along with the track, so that the forming pass of each die forms the workpiece by changing the swing angle at which the forming pass is abutted onto the edge of the workpiece at, e.g., a change rate in an angle changing pattern according to a predetermined change rate.

In addition, in the forming machine and the forming method having the above configuration, the present inventors propose a configuration in which the angle control mechanism continuously changes the swing angle of the forming pass by a rack and pinion mechanism converting the straight moving to the die swing moving with the moving by following the following track provided along with the straight or substantially straight track, and a configuration in which the forming pass of each die has a substantially L-shaped cross section; a configuration in which one or more support rolls which are abutted onto the width's center of the workpiece from the outer surface thereof to be bent are arranged for forming between the opposite rotating units in the width direction or the advancing direction of the workpiece or both directions thereof;

a configuration in which one or more support rolls which are abutted onto the workpiece which has just exited from the forming segment, from the outer surface thereof to be bent are arranged for forming in the circumferential direction or the advancing direction of the workpiece or both directions thereof; and a configuration in which a support roll train in which when a plurality of support rolls are abutted onto the width's center of the workpiece from the outer surface thereof to be bent for forming, the rolls being supported in roll holders connected to be a conveyor belt, the rolls between the rotating units are conveyable to both the downstream and upstream sides of the workpiece, and the roll caliber curvature radius of the rolls is sequentially smaller from the downstream side to the upstream side, is arranged between the opposite rotating units, and is selected by moving the position of the conveyor belt.

Effect of the Invention

In the present invention, the forming machine has the pair of rotating units each having the die train rotated on the endless track by making the abutment angle of each die itself onto the edge of the workpiece changeable, and performs angle control of each forming pass so as to change the swing angle at the predetermined change rate when the die is continuously moved on the straight track as the forming segment, so that desired bending can be performed by continuously holding the edge of the workpiece along the edge track in the roll flower showing the forming process from a raw plate into a pipe by the predetermined forming method such as the circular bending (hereinafter, called forming flower), and consequently, like the press forming, the workpiece is basically subjected only to two-dimensional deformation in cross section, thereby enabling forming with less additional deformation and residual stress.

In addition, in the present invention, since the edge of the workpiece is continuously held along the edge track in the predetermined forming flower, forming is enabled along the stable edge track, twisting which is likely to occur in the roll forming can be completely prevented, and the abutment of the edges can be reliably performed to remarkably improve the welding quality, which is optimum particularly for laser welding which requires the abutment precision of the edges.

In brief, in the present invention, forming with less deformation and resistance in the advancing direction of the workpiece, which cannot be realized by the forming rolls, is enabled, and the predetermined stable edge track can be ensured; therefore, without forcing excessive forming at both edges of the workpiece, the productivity and yield improvement effect can be obtained, the energy necessary for forming is small, the processing hardening and the residual stress are low, and the effect of improving the surface quality including the welding quality is high, thereby enabling pipe manufacturing with extremely high quality.

In the present invention, in pipe manufacturing using an extremely thin, thick, or high-hardness material, which has been difficult to form by the roll forming, any problems specific to the rolls, such as increased entry resistance and wavy edges due to twisting onto the rolls and material galling due to the circumferential speed difference between the roll surfaces, cannot arise, thereby enabling pipe manufacturing with high quality.

In the present invention, pipe manufacturing using a non-long and continuous workpiece is enabled, so that sheet materials and coil materials are not required to be connected and welded, thereby making the coil joining equipment on the entry side and the driving cutting machine on the exit side unnecessary, and further, since there no sheet material width limitation, thereby enabling a large-diameter steel pipe to be manufactured; therefore, the so-called UOE forming method can be replaced.

In the present invention, since the machine having the pair of rotating units performing the breakdown step is relatively simplified, without any mechanical configurations interfering with each other, the forming tool replaceability is high, and since the edge of the workpiece is continuously held in forming, each die whose pass has an L-shaped cross section can form thin and thick materials by one forming machine, and the interval between the opposite rotating units is changed to pass a raw plate having various plate widths, and forming is enabled at a diameter rate increased several times, whereby the replaceable forming machine can reduce the cost.

Further, the forming effect in which a desired forming shape can be reliably obtained in the breakdown step performed by holding the workpiece by one forming machine at all times is high; therefore, as compared with the conventional forming method and a forming machine, any equipment used before and after the breakdown step can be omitted and multiple equipment arrangement can be simplified into single equipment arrangement, so that the equipment cost in the pipe manufacturing line can be reduced.

BRIEF DESCRIPTIONS OF THE DRAWINGS

BEST MODE FOR CARRYING OUT THE INVENTION

Figure 1:
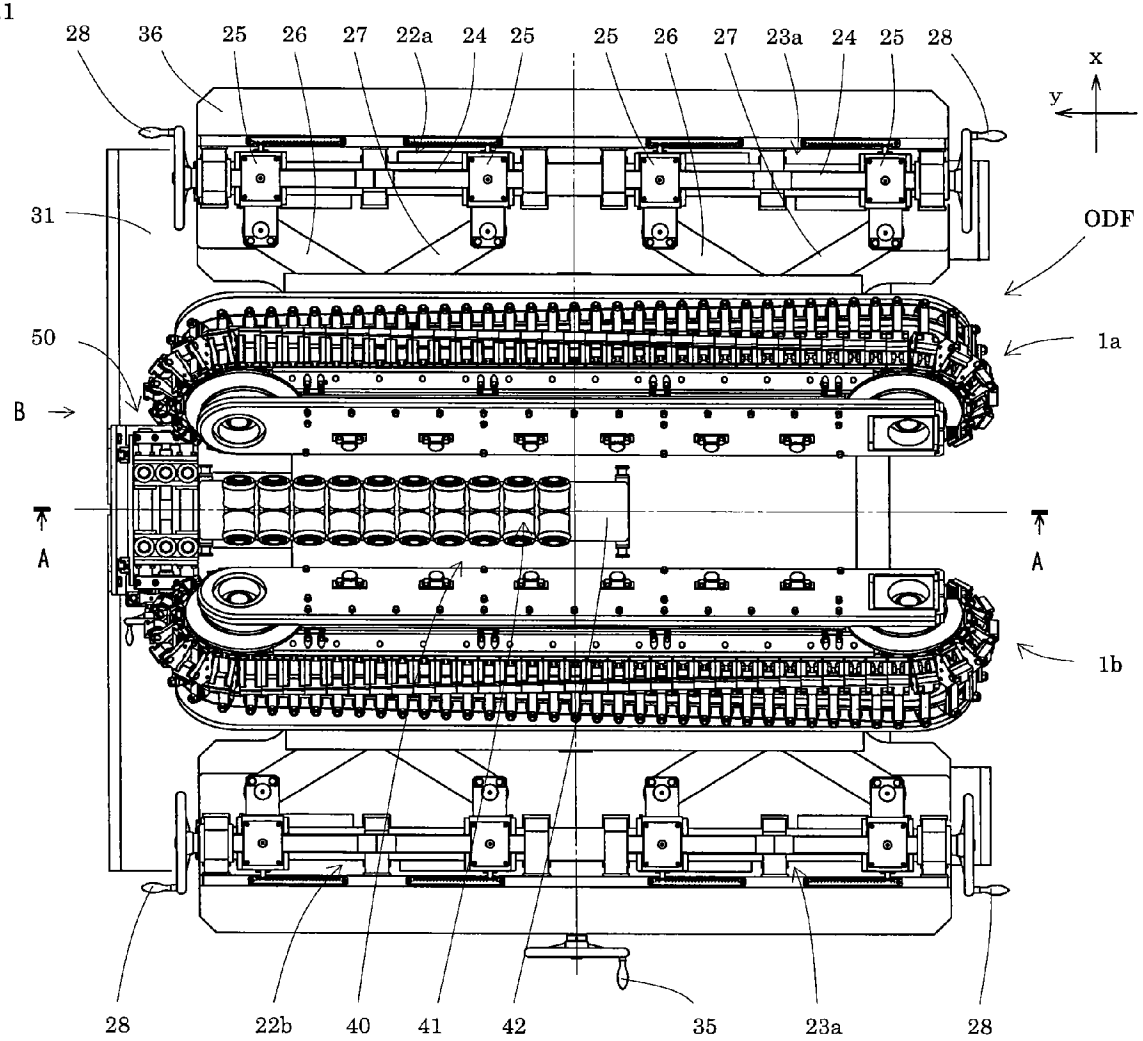
FIG. 1 is a plan explanatory view of a forming machine.

A configuration example of a forming machine having a pair of rotating units according to the present invention will be described. As shown in FIGS. 1 to 4, here, rotating units 1*a* and 1*b* are rotated on long elliptical tracks. Accordingly, there is used each endless die train 5 axially supported between the ends of upper and lower long face plates 2 and 3 of two sprockets (not shown) and having a plurality of dies 10 connected by pins 14 in the rotating direction via die holders 12 to form an endless train, the pins 14 inside the die train 5 are engaged with the sprockets, and the die train 5 is entrained by large-diameter support rollers 4 incorporating such sprockets. Therefore, each of the rotating units 1*a* and 1*b* can rotate the die train 5 by rotatably driving one or both sprockets by a driving motor 8.

The rotating units 1*a* and 1*b* are supported by inclining frames 20*a* and 20*b* having the same length in the x direction to be inclined in the z direction at a predetermined angle, so that the inclining frames 20*a* and 20*b* themselves are supported by slide mechanisms 21*a* and 21*b* slid in the y direction via the sliding alloy on a shared bed 36. Here, a long hole in the y direction is provided at the center in the x direction of the slide surface of each of the inclining frames 20*a* and 20*b*, so that a pin projected toward the bed 36 is then inserted into the long hole in the y direction to regulate the movement in the x direction of each of the frames 20*a* and 20*b*. In each of the inclining frames 20*a* and 20*b* placed on one side in the x direction of the bed 36 or on the opposite side of the machine, its slide position in the y direction is regulated by link mechanisms 22*a* and 22*b* or 23*a* and 23*b* on the other side in the x direction of the bed 36.

Each of the link mechanisms 22*a*, 22*b*, 23*a*, and 23*b* for slide position control can regulate the slide amount in the y direction in such a manner that arms 26 and 27 are provided on a pair of nut sliders 25 threaded into a threaded rotational shaft 24 to be close thereto and to be away therefrom, and the other end of the arm 26 and the other end of the arm 27 are closed to be connected to each of the inclining frames 20*a* and 20*b*, thereby rotating the rotational shaft 24 by a handle 28.

A set of link mechanisms 22*a* and 22*b* is provided in the x direction on the inclining frame 20*a*, and a set of link mechanisms 23*a* and 23*b* is provided in the x direction on the inclining frame 20*b*, so that, as described above, the movement thereof in the x direction can be regulated by the pin and long hole mechanism; however, the parallel moving and the inclining moving are enabled in the y direction.

Figure 10:
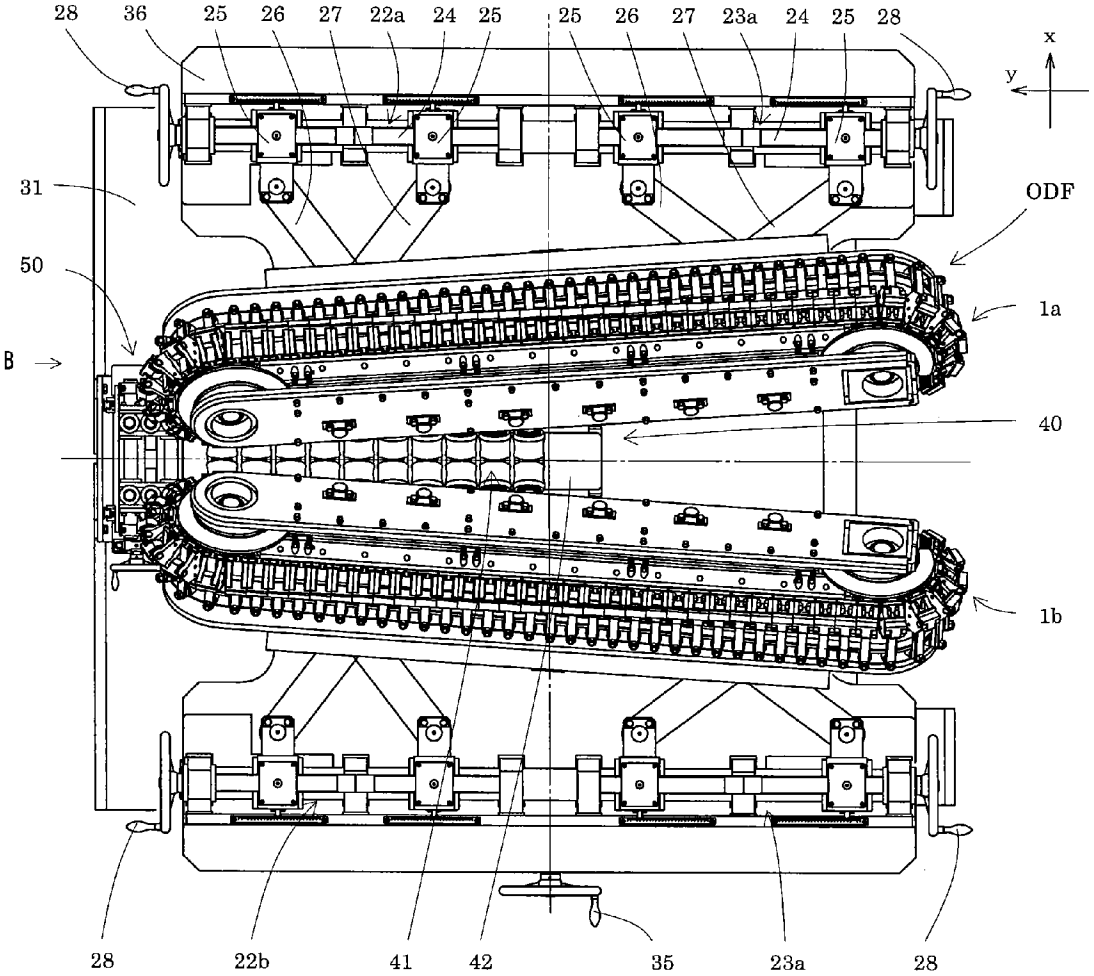
FIG. 10 is an explanatory view, in a plan explanatory view of the forming machine shown in FIG. 1, in which the interval between the opposite rotating units is largely opened on the entry side of the raw plate.

By inclining moving in such a configuration, as shown in FIG. 10, the interval between the opposite rotating units 1*a* and 1*b* in the x direction can be sequentially smaller from the raw plate width on the entry side toward the pipe width on the exit side.

The bed 36 on which the rotating units 1*a* and 1*b* are placed via the inclining frames 20*a* and 20*b* is supported on a base 31 to be raised and lowered, so that support shafts 32 regulate the moving in the x and y directions by hanging two raising and lowering shafts in the x direction from the lower surface of the bed 36 to insert them through bearings on the base 31. The bed 36 is raised and lowered by additionally providing raising and lowering jacks 33 on the base 31, and by appropriately arranging a shaft 34 transmitting rotation to the gear boxes of the raising and lowering jacks 33 to rotate a handle 35 at the end thereof.

In the detailed description of the configuration of the die train 5, here, the die train 5 is formed by axially supporting each die 10 by a shaft 13 arranged in the connecting direction in the die holder 12 so that a forming pass 11 of the die 10 is rotated to be outwardly directed and is swingably held, whereby a connecting portion for convex and concave fitting is provided in the die holder 12 to be connected to the adjacent die holder 12 by the pin 14. As described above, the die train 5 is entrained by the large-diameter support rollers 4 incorporating the sprockets.

Here, the endless tracks of the rotating units 1*a* and 1*b* are two straight tracks in the x direction and two rotating tracks, and between the pair of support rollers 4, six large-diameter backup rollers 6 are axially supported between the face plates in series in the x direction so that the axes thereof are parallel with the axes of the sprockets, and are contacted onto the back side of the die train 5 so as to receive the forming load in the y and z directions of the die train 5 on one of the straight tracks.

Figure 4A:
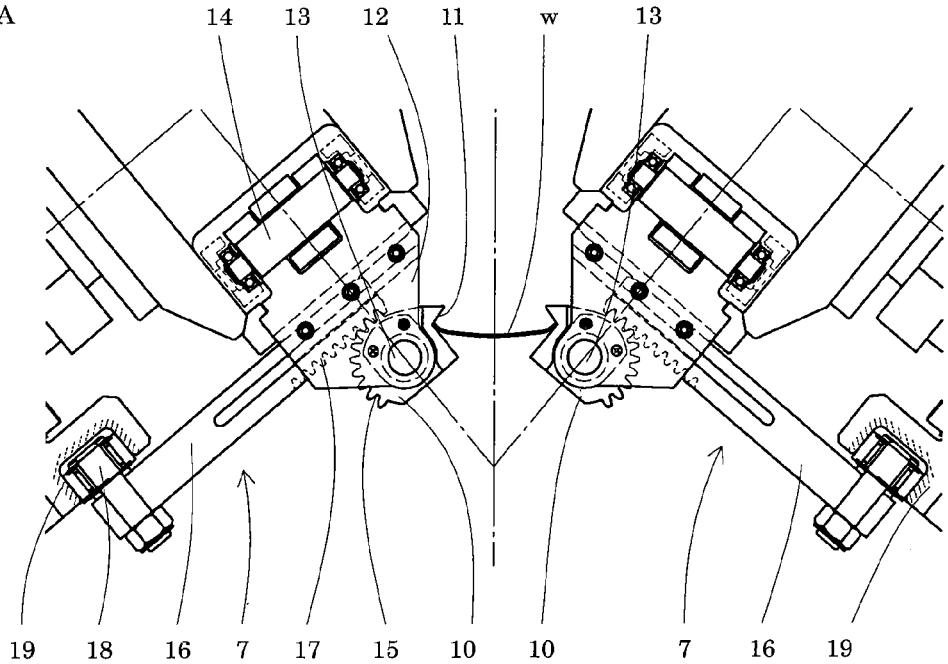
FIG. 4A shows a transverse cross section of a workpiece in a state where it is abutted onto first dies in a forming segment of the forming machine, and is a longitudinal explanatory view showing the detail of the dies and angle control mechanisms.
Figure 4B:
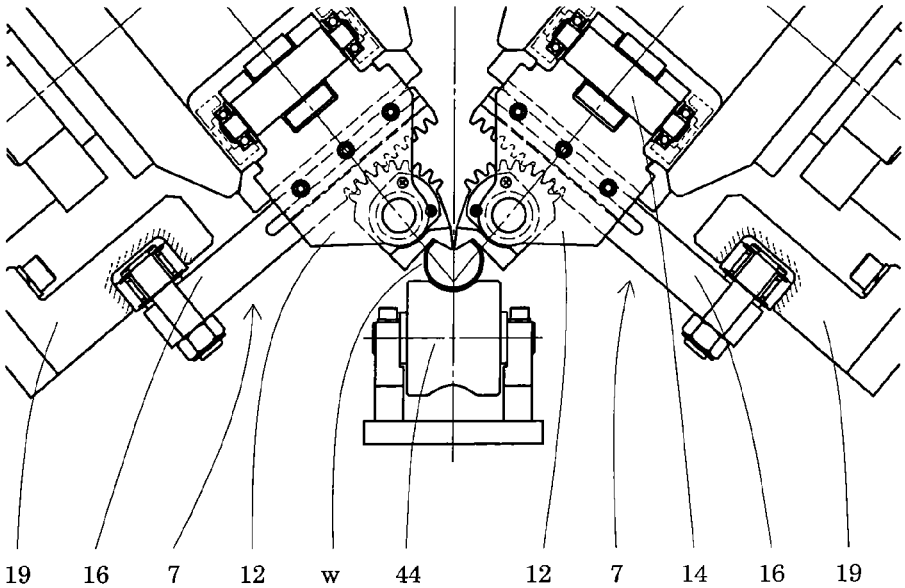
FIG. 4B shows a transverse cross section of the workpiece in the state where it is abutted onto the last dies in the forming segment of the forming machine, and is the longitudinal explanatory view showing the detail of the dies and angle control mechanisms.

Each of the rotating units 1*a* and 1*b* has angle control mechanisms 7 changing and holding the swing angle of the forming pass 11 of each die on the straight track having the forming load receiving mechanism. As shown in FIGS. 4A and 4B, here, in each angle control mechanism 7, an arc gear surface 15 is provided on the back side of the forming pass 11 of the die 10 axially supported in the die holder 12, and is engaged with a rod 16 having a straight gear surface 17 in the y-z plane orthogonal to the axially supporting direction to configure a rack and pinion mechanism, and a roller follower 18 is provided at the other end of the rod 16.

Therefore, the die train 5 accordingly has an endless train formed by connecting a large number of die holders 12. The die holders 12 each incorporate the rod 16 that hangs therefrom and is engaged with the die 10 itself and the arc gear surface 15 at the back of the die 10. The die 10 is axially supported by a corresponding one of the die holders 12 and is provided with the outwardly directed forming pass 11. In other words, the dies 10 respectively incorporated in the connected die holders 12 and the hung rods 16 rotate in pairs, so that the rods 16 each have a track face plate 19 along with the roller follower 18 at the end of the rod 16 rotates. The rod 16 provided with the track face plate 19 functions as a push rod. The rod 16 is positionally regulated by the track height of the track face plate 19.

Here, the track face plate 19 having an inclination angle in the x direction is arranged on the straight track, so that when the die train 5 passes on the straight track, the rod 16 follows the inclined track face plate 19 to convert the straight moving to the rotation moving in which the die 10 is swung, whereby the forming pass 11 of the die 10 can continuously change the swing angle.

Figure 2:
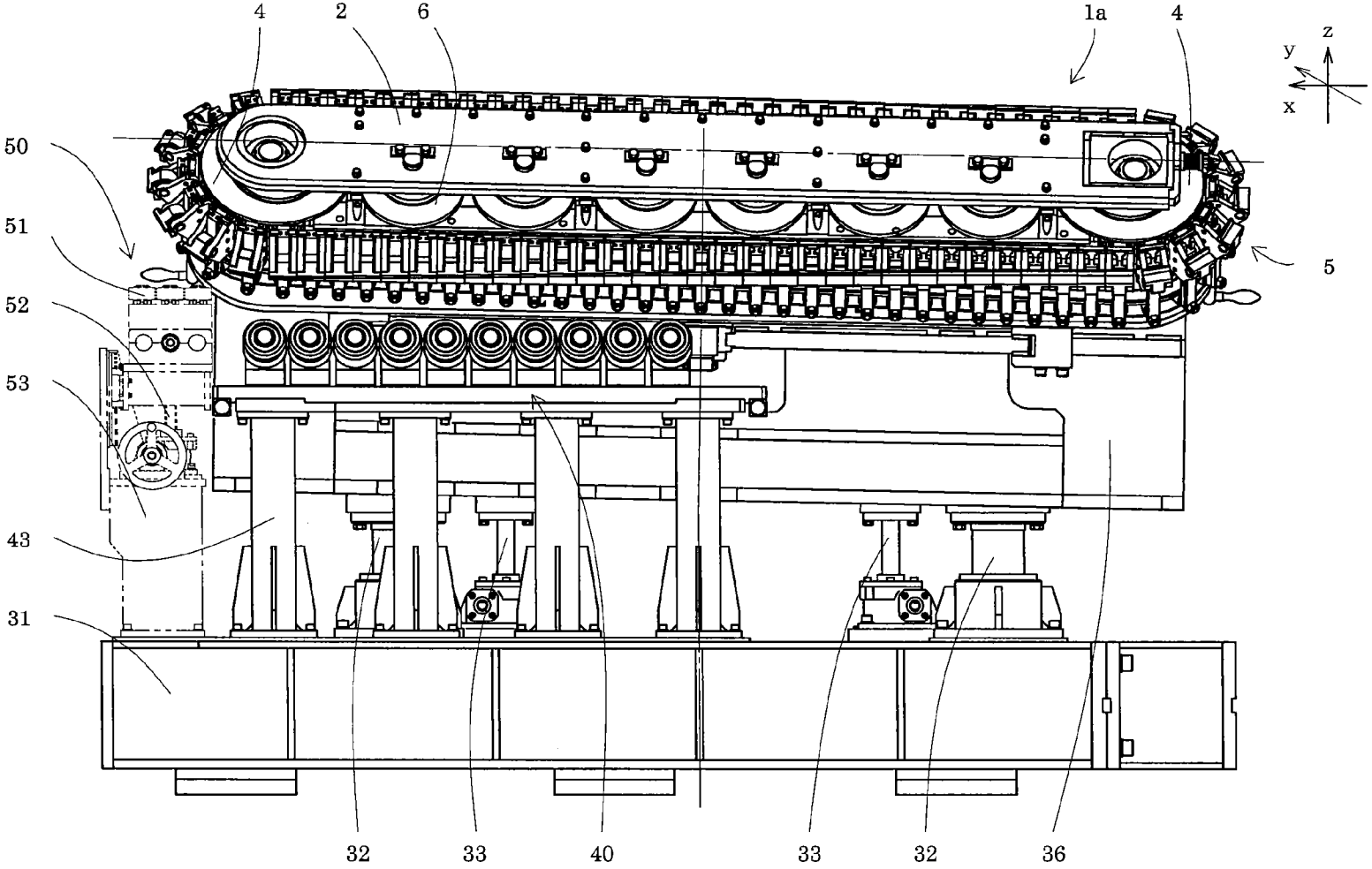
FIG. 2 is a front explanatory view showing the configuration of a rotating unit, seen in a cross section taken along line A-A of FIG. 1.
Figure 3:
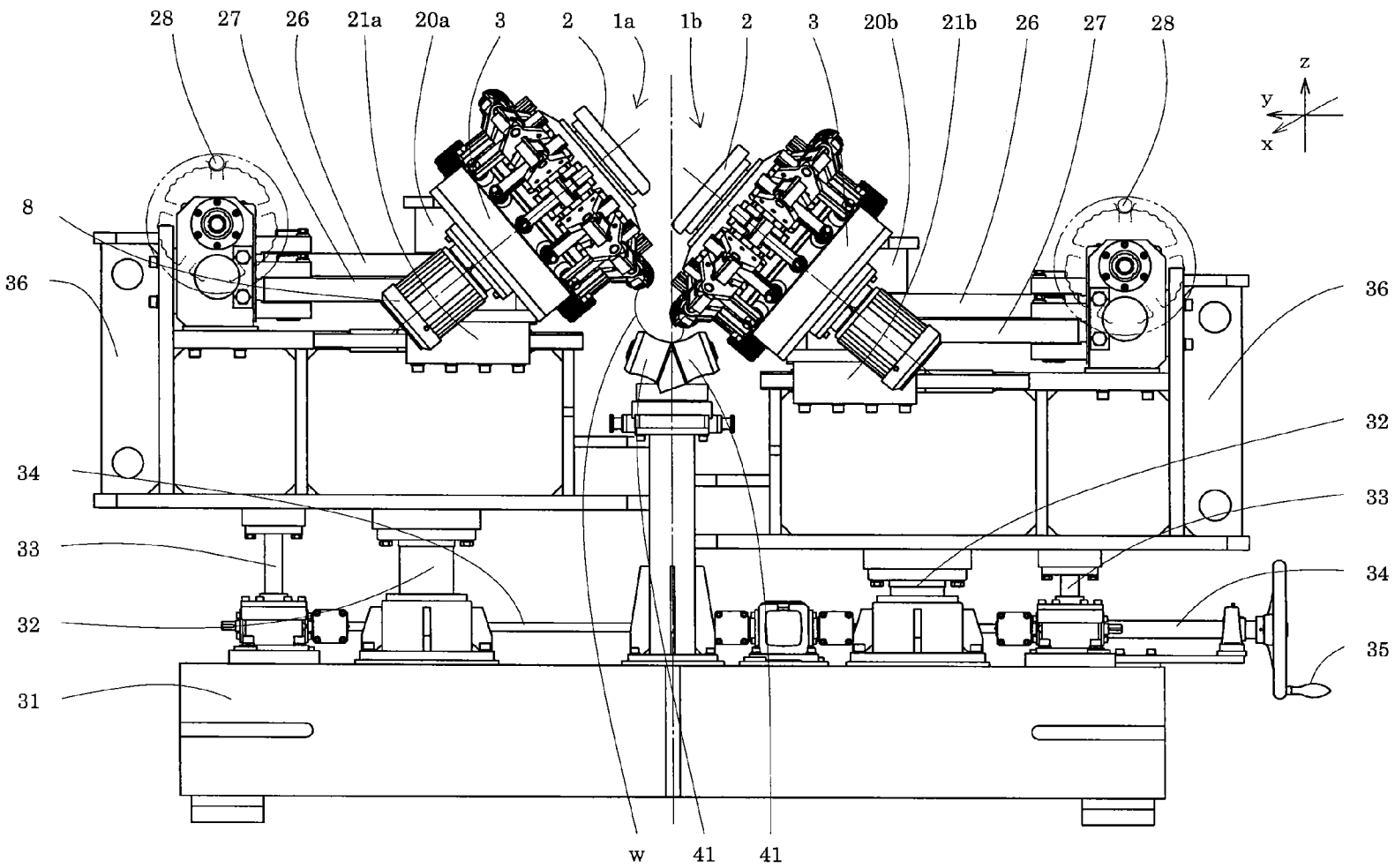
FIG. 3 is a side explanatory view of the forming machine, seen from the direction indicated by B of FIG. 1, in which the right side of the center line of the drawing shows predetermined smallest-diameter pipe manufacturing in the forming machine, and the left side of the center line of the drawing shows predetermined largest-diameter pipe manufacturing in the forming machine.

As shown in FIGS. 1 and 2, in the configuration of the forming machine (Orbiter Die Forming Machine (ODF)), the rotating units 1*a* and 1*b* are arranged so that the straight tracks each having the forming load receiving mechanism and the angle control mechanisms 7 are opposite to each other and that a workpiece w enters from the right side of the drawing and exits to the left side thereof. Here, in order that the interval between the opposite rotating units 1*a* and 1*b* in the y direction is smaller in the x direction, the opposite rotating units 1*a* and 1*b* are maintained horizontal in the z direction, and as shown in FIG. 3, the rotating units 1*a* and 1*b* are inclined to have a V-shape in cross section, seen from the x direction.

In forming machine ODF, the straight tracks on which the rotating units 1*a* and 1*b* are opposite to each other enable the workpiece w to enter into between the opposite forming passes 11, so that the forming passes 11 are swung according to the angle control mechanisms 7 so as to hold both edges in the advancing direction of the workpiece w to be moved therewith, and this segment becomes a forming segment in which predetermined forming is performed.

Prior to the description of a forming method according to the present invention, the forming methods in the section of the conventional art will be described. FIG. 5B shows an explanatory view of a roll flower showing a forming process from the workpiece w into a pipe by the conventional circular bending method. Assuming that a raw plate is sequentially bent into a pipe by n forming rolls, the forming amount is allocated to complete bending from the width's center of the raw plate toward both edges thereof at n stages, thereby finally bending the edges, and when the width's center of the raw plate which becomes a pipe bottom is fixed, the track of the edges of the raw plate is represented, as shown in FIG. 5B.

Figure 5A:
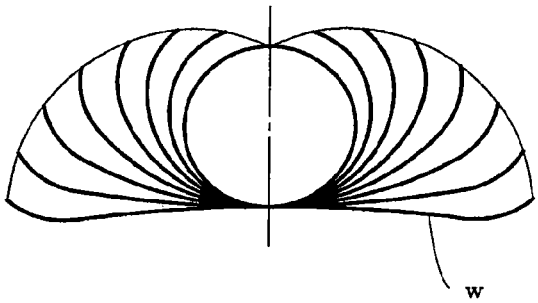
Fig.5A BACKGROUND ART
FIG. 5A is a roll flower explanatory view showing a forming process from a raw plate into a pipe by a conventional double bending method.
Figure 5B:
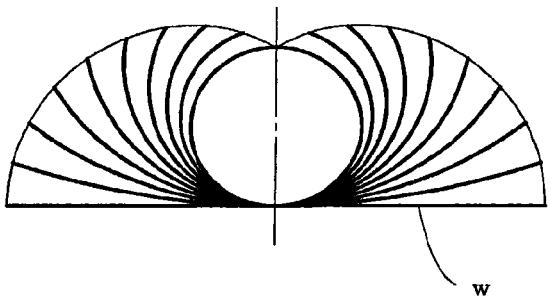
Fig.5B BACKGROUND ART
FIG. 5B is a roll flower explanatory view showing a forming process from a raw plate into a pipe by a conventional circular bending method.

In addition, in the description of a forming process from a raw plate into a pipe by the conventional double bending method with reference to FIG. 5A, at first, the width's center of flat the workpiece w is raised to bend both edges by the upper and lower convex and concave rolls, and then, while reversing the width's center, the workpiece w is bent from the width's center like the circular bending method; however, since the edges are formed at first, a good edges abutment state necessary for joining can be easily obtained.

In the conventional forming methods using the forming rolls, basically, the forming rolls only make a point contact or a line contact with the workpiece w in such a manner that the raw plate is interposed between the convex and concave rolls or that the raised raw plate is pressed from its outside by using the side rolls and cage rolls, and in the edge bending method, both edges which have been subjected to the early-stage forming are not held for bending in the breakdown step, while in the circular bending method, both edges are bent by the fin pass rolls at multiple stages for the welding step after the completion of the breakdown step.

Figure 6A:
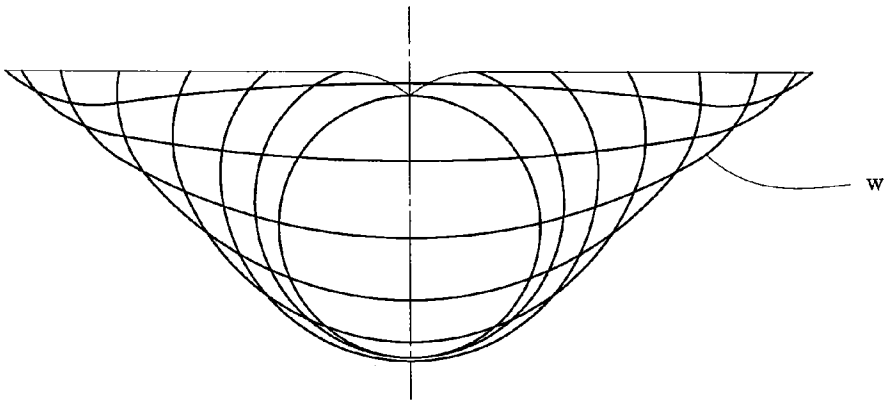
FIG. 6A is a roll flower explanatory view showing a forming process from a raw plate into a pipe by a double bending method of Examples.
Figure 7:
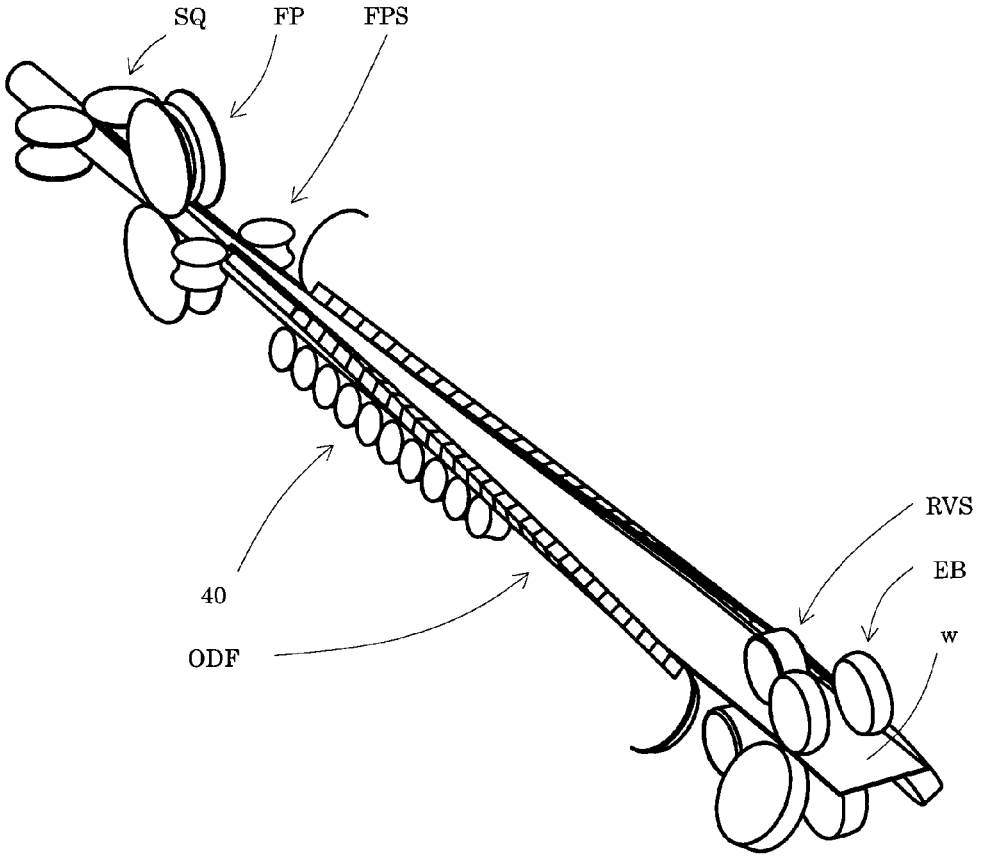
FIG. 7 is a perspective explanatory view showing a workpiece in which the forming process by a double bending method of Examples is simulated, and showing a state where the forming machine of Examples is removed.

On the contrary, in the present invention, in any of the forming methods, throughout the breakdown step, both edges of the workpiece are continuously held for bending, as shown in the explanatory view of FIG. 7 in which the forming process is simulated, along the track of both edges in the predetermined forming flower. In performing the forming method of the present invention, when the forming flower of e.g., the double bending method is adopted, the roll flower of FIG. 5A represents the track of both edges of the raw plate, with the plate width's center which becomes the pipe bottom of the workpiece w fixed; however, in the present invention, as shown in FIG. 6A, the plate width's center which is the pipe bottom of the workpiece w is moved to fix the track of both edges in the horizontal position; therefore, FIG. 6A shows quite the same forming step as FIG. 5A although they are differently shown.

As described above, in forming machine ODF, the rotating units 1*a* and 1*b* are opposite on the straight tracks; in other words, the forming segment is between the straight tracks in which the workpiece w is enabled to enter into between the opposite forming passes 11, and in the forming segment in which the forming passes 11 hold both edges in the advancing direction of the workpiece w to be moved therewith, it is maintained horizontal in the height z direction.

However, each forming pass 11 changes the abutment angle according to the rod 16 of the angle control mechanism 7 incorporated in each die holder 12 so that the substantially upwardly directed pass 11 is sequentially directed downwardly, and the interval between the opposite forming passes 11 is made smaller; therefore, in the forming segment in which the forming passes 11 hold both edges in the advancing direction of the workpiece w to be moved therewith, the predetermined forming along the track as shown in FIG. 6A can be performed.

As shown in the longitudinal side view of FIG. 4A in the position of the first dies 10 abutted onto the workpiece w, in the plan view of forming machine ODF shown in FIG. 1, the forming passes 11 abutted onto both edges of substantially flat the workpiece w are directed substantially upwardly; however, in the longitudinal side view of FIG. 4B in the position of the last dies 10 in the forming segment, the workpiece w is formed into a substantially circular shape, and the forming passes 11 of the dies 10 holding both edges are directed downwardly.

Therefore, in forming machine ODF, in the forming segment having the straight tracks of the rotating units, the forming passes hold both edges in the advancing direction of the workpiece to be moved therewith, thereby completing the breakdown step.

As shown in forming machine ODF in FIGS. 1 and 2, in order to receive the forming reaction force when both edges of the workpiece w are held for bending, and further, to appropriately control the forming amount allocation according to the rotating angle of each die 10 in the advancing direction of the rotating units 1*a* and 1*b*, lower rolls as support rolls abutted onto and supporting the width's center of the workpiece w in the forming segment from below are necessary, so that a large number of small-diameter rolls 44 each having a concave surface according to the curvature on the pipe bottom side in the roll flower in FIG. 4B or bisected rolls 41 including small-diameter rolls which are bisected in the width direction and change the abutting direction can be arranged in the x direction.

In addition, the surface of each lower roll has a curvature required according to target diameter in the arranging position in the advancing direction, so that in addition to being used as the shared roll like Example 1, the lower roll is used as a replaceable roll like Examples 2 and 3, a cassette plate and a conveyor belt in which each roll is given a dedicated curvature according to target diameter.

In place of a lower roll unit 40 abutted onto the outer surface of the workpiece w to be bent to perform such support, a support rotating unit including a die train in which dies with passes having a predetermined curvature are connected can be adopted, and one or more units can be arranged in the x direction.

Forming machine ODF shown in FIGS. 1 and 2 enables forming even when the illustrated top and bottom are rotated 180° or 90°, and in this case, such support rolls are arranged as upper rolls or side rolls.

In addition, when the target diameter and the width of the workpiece w are large, one or more support rolls abutted onto the outer surface of the workpiece w to be bent can be arranged in the width direction or the advancing direction of the workpiece w or both directions thereof.

Further, on the exit side of forming machine ODF, one or more support rolls can be arranged in the width direction or the advancing direction of the workpiece w or both directions thereof.

In the forming machine according to the present invention, other driving-type forming roll stands are provided ahead and behind the pipe manufacturing line, so that the rotating units are not always required to be rotatably driven; however, desirably, at least the rotating units themselves have a driving force to the extent that they cannot resist the passing of the raw plate.

The configuration and shape of each die and the forming pass thereof are not limited, and in the above drawing, each forming pass has a substantially L-shaped cross section for manufacturing a welding pipe; however, even in the same pipe manufacturing, when, like a caulk pipe and a flanged pipe whose edges are not welded, a predetermined edge shape is formed to form a pipe shape, each die should have a pass shape which can be held according to edge shape. Therefore, in addition to the above pipe materials, the forming method and a forming machine of this invention enable forming even from an open channel material having various cross-sectional shapes.

Further, in addition to the plane having a substantially L-shape cross section, each forming pass can have a substantially L-shape cross section given a curved face according to the curvature of the portion continued to the edge of the material.

In the rotating unit of this invention, in addition to the long elliptical track, any known endless tracks such as a rectangular track and a triangular track can also be adopted. In addition to the sprocket, any rotating mechanisms such as a gear and a rotational bearing can be adopted.

Likewise, in addition to the large-diameter support bearings arranged in series, any known load receiving mechanisms such as a sliding plate and a face plate in which a large number of small-diameter rollers are arranged can also be adopted.

In the die train, the forming passes of the dies are swingably held in the z direction; however, in addition to the configuration in which the dies themselves swingably holding the forming passes are connected, any known conveyor and chain, such as a configuration in which the die holders swingably holding the dies are connected, a configuration in which a chain swingably holds the dies, and a configuration in which bearings are incorporated in the dies, which is described in Patent Document 4, can be adopted.

In Examples, the straight tracks having a predetermined length configure the forming segment by the rotating units; however, the substantially straight tracks such as predetermined arc portions of an imaginary large-diameter circle, which is described in Patent Document 4, can be adopted.

In the angle control mechanism, in addition to the mechanical mechanism in which the rod which has at one end the rack engaged with the swingably axially supported die which is made into a substantially pinion and has on the other end the roller follower changes the straight moving on the inclined track to the die rotational moving, any known mechanical mechanisms changing the straight moving and the rotational moving can be adopted.

In addition, when the swing angle of each die is changed by the angle control mechanism at the change rate in the angle change pattern according to the predetermined forming step, in Examples, angle control is performed to make the angular speed constant since each forming pass has a substantially L-shape cross section; however, the controlling method should be appropriately selected according to the previously selected forming step, the tracks configuring the forming segment, the angle control mechanism, and the forming pass configuration.

EXAMPLES

Figure 8A:
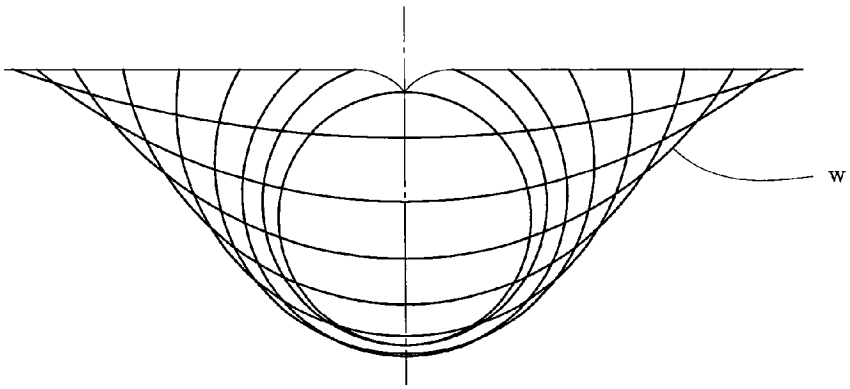
FIG. 8A is a roll flower explanatory view showing a forming process from a raw plate into a pipe by a circular bending method of Examples.

In Examples 1 and 2, with the use of forming machine ODF shown in FIGS. 1 to 3, forming from a raw plate into a pipe is performed by the double bending method shown in FIG. 6A and the circular bending method shown in FIG. 8A. As described later, although there is the portion in which the target diameter ranges in pipe manufacturing are overlapped according to the difference between the forming methods, the target diameter ranges are set to be different, the forming machines themselves have quite the same configuration, and the sizes of the machines are simply analogously different according to the diameter range difference.

In the present invention, the replacing range of one machine is wide; however, pipes having small and large diameters are able to be manufactured only by analogously changing the size of the machines of the same design.

Example 1

Figure 6B:
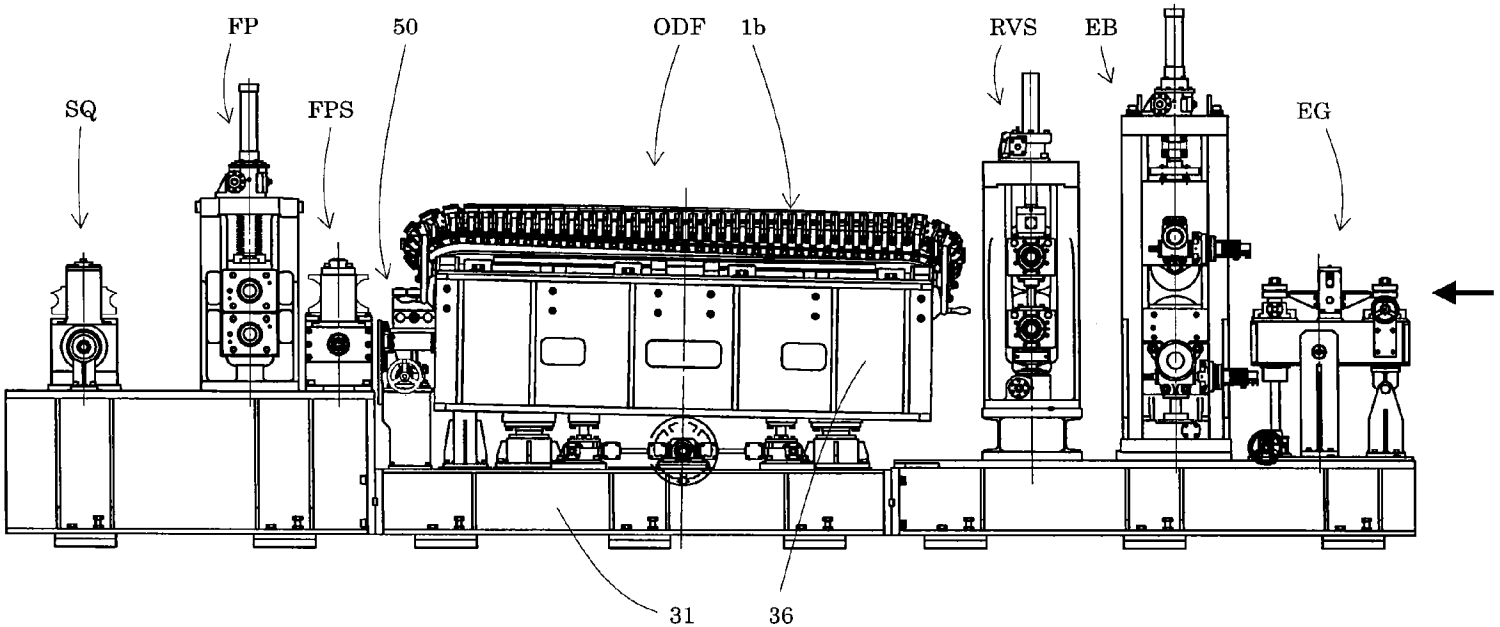
FIG. 6B is an explanatory view showing a pipe manufacturing line stand configuration example adopting a double bending forming method of Examples.

A pipe manufacturing line stand configuration by the double bending method in which, as shown in FIG. 6B, the right side in the drawing is the entry side, has entry guide stand EG having grooved side rolls for feeding the workpiece w in a raw plate state, edge bend stand EB having upper and lower rolls which form both edges of the workpiece w into a predetermined arc shape, reverse bend stand RVS having upper and lower rolls reversing the plate width's center raised by edge bend stand EB, a forming machine ODF stand having the pair of rotating units performing the breakdown step of forming the plate into a substantially circular shape, fin pass roll stand FP having upper and lower rolls for abutting the edges for welding after the completion of the breakdown step, and fin pass side roll stand FPS having side rolls at the previous stage thereof, and squeeze roll stand SQ performing welding at the last stage, and here, TIG welding is adopted.

As shown in FIGS. 1 and 2, in forming machine ODF, the lower roll unit 40 in which a large number of bisected rolls 41 whose curvature is selected according to predetermined forming diameter are arranged side by side on a shared bed 42 by performing predetermined height adjustment is placed on a stand 43 erected on the base 31 at a predetermined height, so that it is replaceable in each replacing range.

In addition, here, in order for the workpiece w which has exited from the forming segment to be easily separated from the forming passes 11 of the dies 10, a side roll unit 50 equipped with small-diameter side rolls 51 and lower rolls as support rolls on the exit side of forming machine ODF is placed via a raising and lowering mechanism 52 on a stand 53 on the base 31.

In the replacing range of forming machine ODF, assuming a diameter of 38.1 mm to 114.3 mm and a thickness of 0.6 mm to 6.0 mm, the largest line load for designing the machine was 60 kgf/mm. The line speed was set to 10 m/min. TIG welding was used.

Pipe manufacturing was performed by using stainless steel (SUS304) and a high-tension steel plate as a workpiece and by combining various diameters and thicknesses in the replacing range; as a result, the entry resistance of the workpiece was less, the leading and trailing edges of the material were not extended and deformed, forming was enabled with less additional deformation and residual stress like the press forming, there was no galling at all so that the surface quality was good, rolling was able to be completely prevented, and the edges abutted state was extremely good to remarkably improve the welding quality as compared with the conventional forming machine.

From the workpiece shown in FIG. 7 in which the forming process by the double bending method of Example 1 is simulated, it is found that, throughout the breakdown step, the edges of the workpiece can be continuously held for bending along the track of both edges in the predetermined roll flower, the entry resistance of the workpiece is small, rolling can be completely prevented, and the edges abutted state is extremely good.

In the conventional pipe manufacturing using the forming rolls, although the machine configuration is different, a large number of electrically operated motors for the driving rolls are required to be prepared since the entry resistance of the workpiece, even normal steel, is great, and, of course, additional deformation and residual stress cannot be avoided for forming.

On the contrary, in forming machine ODF of this invention, the driving motors 8 having a slight driving force to the extent that the rotating units 1*a* and 1*b* themselves do not resist the passing of the raw plate drive the sprockets 4 to rotatably drive the die trains 5, so that the entry resistance is able to be neglected, and there are no galling in the high-strength material at all. The power consumption in the breakdown step can be reduced to ⅓ of that of the conventional forming rolls.

Example 2

The machine of Example 1 was used to manufacture a copper pipe having a diameter of 63.5 mm, a thickness of 0.8 mm, and a length of 4000 mm from a phosphorous-deoxidized copper sheet plate by the double bending method. Likewise, a titanium sheet plate (H4631) was used to manufacture a Ti pipe having a diameter of 63.5 mm, a thickness of 1.2 mm, and a length of 5500 mm. In this case, the lower roll unit shown in FIGS. 1 and 2 was replaced with a replaceable lower roll unit dedicated for each diameter in which rolls having different curvatures dedicated for the target diameter were sequentially arrayed on one shared bed 42 and the forming was performed.

Both the copper pipe and the titanium pipe were excellent in surface quality without galling and surface damage, and were of high quality without any wavy edges in the welding portion.

Likewise, the machine of Example 1 was used to manufacture an aluminum pipe having a diameter of 114.3 mm, a thickness of 1.6 m, and a length of 4000 mm from an aluminum sheet plate (A1070). Also in this case, a plate replaceable lower roll unit in which dedicated rolls having different curvatures suitable for the target diameter of 80 mm to 83 mm were sequentially placed on the shared bed was used.

The obtained aluminum pipe was excellent in surface quality without galling and surface damage, and was of high quality without any wavy edges in the welding portion.

Example 3

Figure 9:
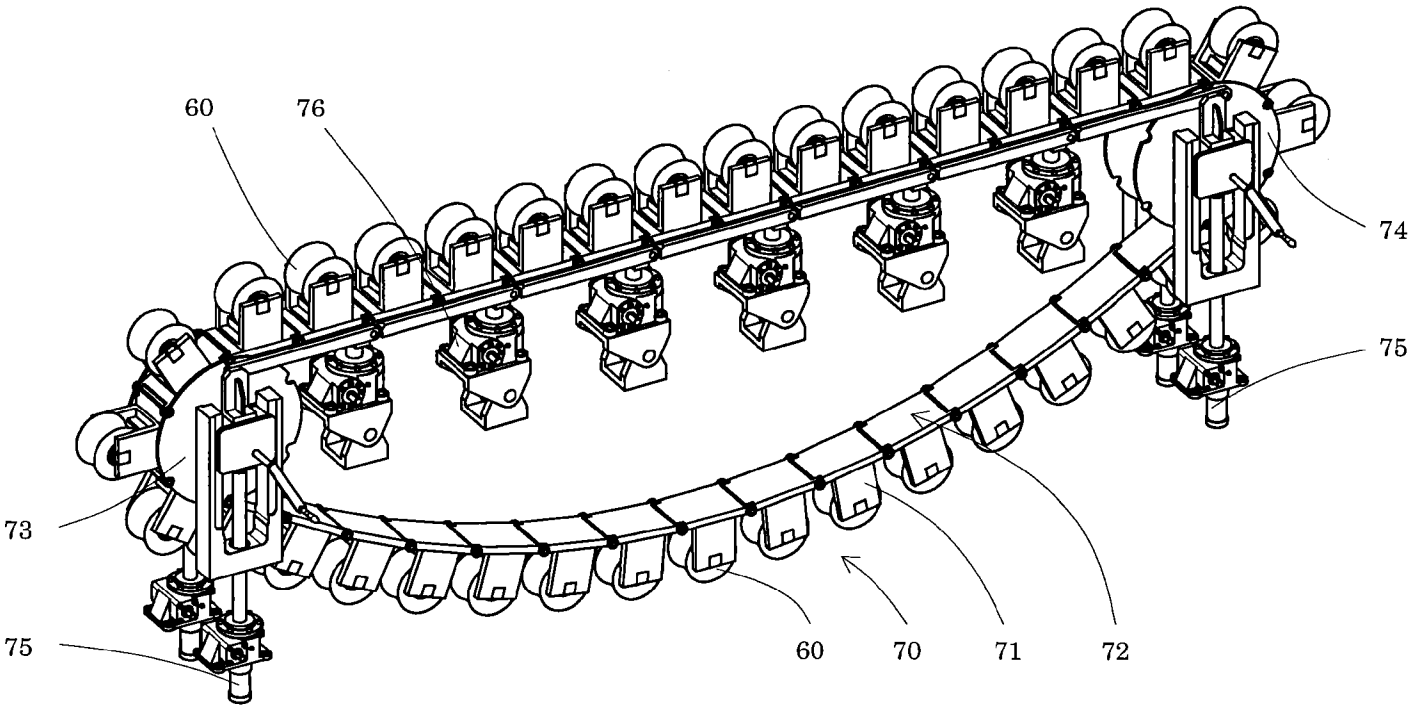
FIG. 9 is a perspective explanatory view showing another example of a lower roll unit.

In forming machine ODE of Example 1, in place of the lower roll unit 40 in which the bisected rolls 41 were arranged on the shared bed 42 placed on the stand 43 erected on the base 31 at a predetermined height, a lower roll replacing device 70 as shown in FIG. 9 was adopted.

In the lower roll replacing device 70, a large number of roll holders 71 axially supporting lower rolls 60 were connected to be a conveyor, and a conveyor belt 72 was movable on a rail supported by jacks 76 by a pair of rotational drums 73 and 74 below the rotating units 1*a* and 1*b*. The rotational drums 73 and 74 are held by jacks 75 between the stands to be raised and lowered, so that the handles of the axially supporting portions of the rotational drums 73 and 74 were turned to rotate the endless conveyor belt 72, thereby moving the lower rolls 60 axially supported in the roll holders 71. The lower rolls 60 were sequentially arrayed by giving the surfaces thereof different curvatures required according to the replacing range of forming machine ODF, so that the lower rolls 60 each having a dedicated curvature required according to target diameter in a predetermined portion between the rotating units 1*a* and 1*b* were able to be replaceably arranged; therefore, of course, the reaction force at the time of forming was able to be supported, and the allocation of the forming amount according to the rotating angle of each die 10 in the advancing direction of the rotating units 1*a* and 1*b* was able to be appropriately controlled.

Although, here, the conveyor belt 72 was endless, the conveyor belt 72 is not required to be endless since the rolls can be selected when it enables conveying to both the downstream and upstream sides.

Example 4

Figure 8B:
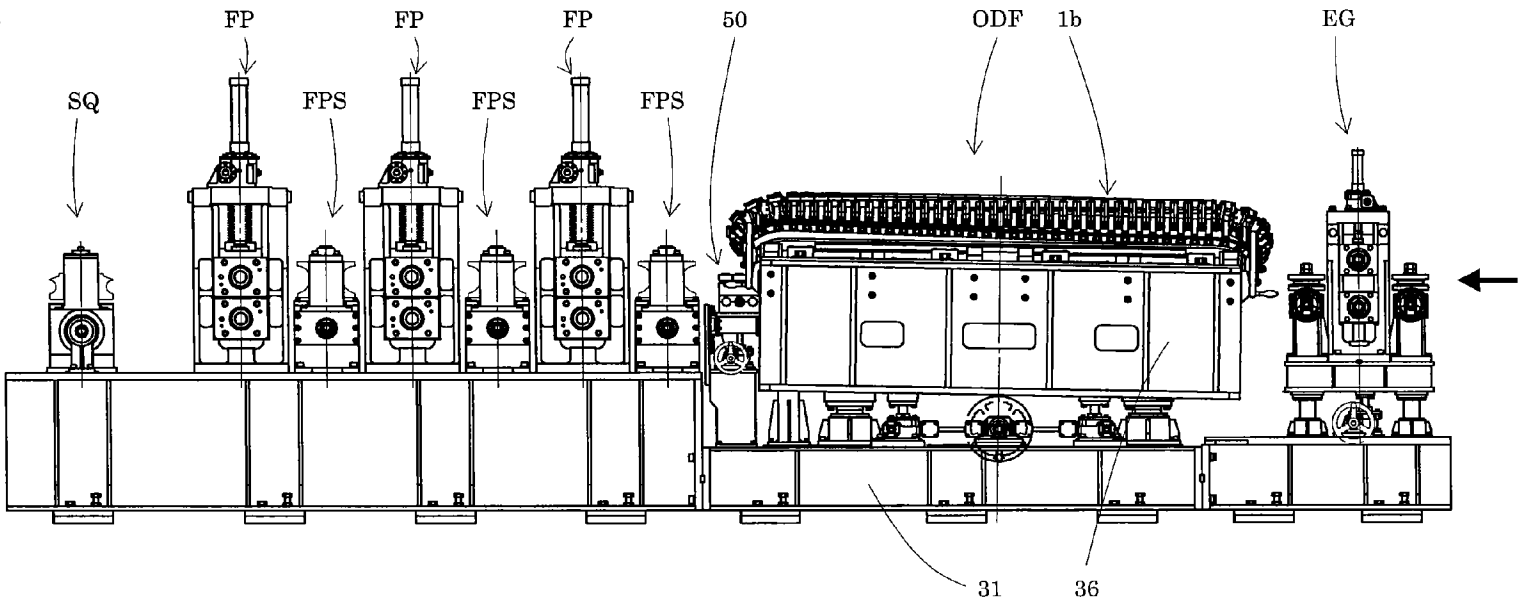
FIG. 8B is an explanatory view showing a pipe manufacturing line stand configuration example adopting a circular bending method of Examples.

A pipe manufacturing line stand by the circular bending method in FIG. 8A, in which, as shown in FIG. 8B, the right side in the drawing was the entry side, had entry guide stand EG having upper and lower pinch rolls and grooved side rolls for feeding the workpiece w in a raw plate state, a forming machine ODF stand having the pair of rotating units performing the entire breakdown step, three fin pass roll stands FP having upper and lower rolls for, after the completion of the breakdown step, forming both edges of the workpiece w into a predetermined arc shape, and abutting the edges for welding, three fin pass side roll stands FPS having side rolls at the previous stage thereof, and squeeze roll stand SQ performing welding at the last stage, and here, high-frequency welding was adopted. The lower roll unit 40 and the side roll unit 50 were provided like Example 1.

In the replacing range of forming machine ODF, assuming a diameter of 60.5 mm to 168.3 mm and a thickness of 0.8 mm to 6.0 mm, and the largest line load for designing the machine was 60 kgf/mm. The line speed was set to 60 m/min.

Pipe manufacturing was performed by using a normal steel as a workpiece and by combining various diameters and thicknesses in the replacing range, and as a result, like Example 1, the entry resistance of the workpiece was small, forming was enabled with less additional deformation and residual stress, rolling was able to be completely prevented, and good surface quality was obtained.

Example 5

To manufacture a large-diameter pipe having a diameter of 630 mm, a thickness of 22 mm, and a length of 18000 mm, a sheet material having a predetermined size is typically subjected to UO forming including C press forming both edges into an arc shape, U press pressing the plate width's center as a pipe bottom, and O press forming the resultant material into a pipe shape. In UO forming, high-pressure press is required to be used for a pressing device, and, in particular, in U press, the bending moment length is short, and the entire length of the material is formed at a time, so that in the above example, a forming reaction force of 700 tonf is received from the workpiece, thereby requiring high-pressure press having forming ability above the reaction force.

On the contrary, in forming machine ODF, the forming reaction force from the workpiece is 180 tonf, so that the necessary rigidity strength of the forming machine is relatively small, the material and manufacturing cost can be greatly reduced, and the energy required for pipe manufacturing can also be greatly reduced by electric power conversion.

In the detailed description, the pipe manufacturing line is substantially the same as FIG. 6B, and has an entry guide stand for feeding a sheet workpiece, an edge bend stand having upper and lower rolls forming both edges of the workpiece into a predetermined arc shape, a forming machine stand having the pair of rotating units performing the entire breakdown step, a fin pass roll stand having upper and lower rolls for, after the completion of the breakdown step, abutting the edges for welding, and a fin pass side roll stand having side rolls at the previous stage thereof, and a squeeze roll stand performing welding at the last stage. The forming roll stands and the forming machine having the pair of rotating units have the same configurations as Examples 1 and 2, but are analogously made larger so as to withstand a forming load assumed.

By such configuration, the large-diameter pipe having a diameter of 630 mm, a thickness of 22 mm, and a length of 18000 mm can be easily manufactured from the sheet material without deforming the leading and trailing edges thereof, and be established as an energy-serving manufacturing method, as an alternative of the UC forming method in view of equipment and power consumption.

INDUSTRIAL APPLICABILITY

In this forming method, both edges of the workpiece are continuously held along the track of both edges in the predetermined roll flower, the workpiece is basically subjected only to two-dimensional deformation in cross section like the press forming, forming is enabled with less additional deformation and residual stress; therefore, together with springback which hardly occurs in the forming process, any problems specific to the rolls, such as wavy edges due to twisting onto the rolls, which is likely to occur in an extremely thin material, and material galling caused by the circumferential speed difference, and material serpentining with lack in material holding force, which is likely to occur particularly in a thick material, are not caused, and consequently, this forming method is optimum for manufacturing a pipe of an extremely thin material, a non-iron metal, a thick material, and a high-hardness material, which have been difficult to form by the roll forming.

In addition, this forming method can manufacture a continuous workpiece at high speed, have a wide device replacing range, enable pipe manufacturing from a single material without connecting and welding sheet materials and coiled materials, be optimum for manufacturing many kinds of pipes and a small number of pipes, and manufacture a large-diameter steel pipe since there is no workpiece width limitation; therefore, UO forming and JCO forming can be replaced with this forming method as an energy-saving manufacturing method.

EXPLANATION OF REFERENCE NUMERALS

EG: Entry guide stand
EB: Edge bend stand
RVS: Reverse bend stand
ODF: Forming machine stand
FPS: Fin pass side roll stand
FP: Fin pass roll stand
SQ: Squeeze roll stand
w: Workpiece
1*a*, 1*b*: Rotating unit
2, 3: Long face plate
4: Support roller
5: Die train
6: Backup roller
7: Angle control mechanism
8: Driving motor
10: Die
11: Forming pass
12: Die holder
13: Shaft
14: Pin
15: Arc gear surface
16: Rod
17: Straight gear surface
18: Roller follower
19: Track face plate
20*a*, 20*b*: Inclining frame
21*a*, 21*b*: Slide mechanism
22*a*, 22*b*, 23*a*, 23*b*: Link mechanism
24: Rotational shaft
25: Nut slider
26, 27: Arm
28, 35: Handle
31: Base
32: Support shaft
33: Raising and lowering jack
34: Shaft
36: Bed
40: Lower roll unit
41: Bisected roll
42: Shared bed
43, 53: Stand
44: Small-diameter roll
50: Side roll unit
51: Side roll
52: Raising and lowering mechanism
60: Lower roll
70: Lower roll replacing device
71: Roll holder
72: Conveyor belt
73, 74: Rotational drum
75: Jack
76: Supporting jack

The invention claimed is:

1. A forming method, comprising:

feeding a work piece to a forming machine, the forming machine including:

a pair of rotating units each including:

a plurality of dies each including a forming pass directed outward and being swingable, the plurality of dies connected to each other in a rotating direction to form an endless die train;

an endless track including a straight or substantially straight track of a predetermined length and allowing the endless die train to rotatably move thereon; and an angle control mechanism configured to change and hold a swing angle of the forming pass of each of the dies, wherein the rotating units are disposed to face each other so as to allow the workpiece to enter between the forming passes of the rotating units, the respective forming passes successively hold both edges of the workpiece in an advancing direction of the workpiece and move in synchronization with the workpiece on the straight or substantially straight tracks that define a forming segment; and bending the workpiece by moving the workpiece through the forming segment, wherein, as the workpiece passes through the forming segment, the angle control mechanisms follow following tracks provided beside the straight or substantially straight tracks, respectively, and change the swing angles of the forming passes which are in contact with the edges of the workpiece, at a preset change rate, so that the forming passes of the respective dies form the workpiece.

2. The forming method according to claim 1, wherein each of the angle control mechanisms includes a rack and pinion mechanism to successively change the swing angles of the forming passes by converting, into a swing motion of each of the dies, a linear motion based on the movement following the following track provided beside the straight or substantially straight track.

3. The forming method according to claim 1, wherein the forming pass of each die has a substantially L-shaped cross section.

4. The forming method according to claim 1, wherein one or more support rolls which are abutted onto the width's center of the workpiece from an outer surface thereof to be bent are arranged for forming between opposite rotating units in a width direction or an advancing direction of the workpiece or both directions thereof.

5. The forming method according to claim 1, wherein a support roll train in which when a plurality of support rolls are abutted onto the width's center of the workpiece from an outer surface thereof to be bent for forming, the rolls being supported in roll holders connected to be a conveyor belt, the rolls between the rotating units are conveyable to both downstream and upstream sides of the workpiece, and a roll caliber curvature radius of the rolls is sequentially smaller from the downstream side to the upstream side, is arranged between the opposite rotating units, and is selected by moving a position of the conveyor belt.

6. The forming method according to claim 1, wherein one or more support rolls which are abutted onto the workpiece which has just exited from the forming segment, from an outer surface thereof to be bent are arranged for forming in a circumferential direction or an advancing direction of the workpiece or both directions thereof.

7. A forming machine comprising:

a pair of rotating units each including:

a plurality of dies each including a forming pass directed outward and being swingable, the plurality of dies connected to each other in a rotating direction to form an endless die train;

an endless track including a straight or substantially straight track of a predetermined length and allowing the endless die train to rotatably move thereon; and an angle control mechanism configured to change and hold a swing angle of the forming pass of each of the dies, wherein the rotating units are disposed to face each other so as to allow a workpiece to enter between the forming passes of the rotating units, the respective forming passes successively hold both edges of the workpiece in an advancing direction of the workpiece and move in synchronization with the workpiece on the straight or substantially straight tracks that define a forming segment, and when the workpiece passes through the forming segment, the angle control mechanisms follow following tracks provided beside the straight or substantially straight tracks, respectively, and change the swing angles of the forming passes which are in contact with the edges of the workpiece, at a preset change rate, so that the forming passes of the respective dies form the workpiece.

8. The forming machine according to claim 7, wherein each of the angle control mechanisms includes a rack and pinion mechanism to successively change the swing angles of the forming passes by converting, into a swing motion of each of the dies, a linear motion based on the movement following the following track provided beside the straight or substantially straight track.

9. The forming machine according to claim 7, wherein the forming pass of each die has a substantially L-shaped cross section.

10. The forming machine according to claim 7, wherein one or more support rolls which are abutted onto the width's center of the workpiece from an outer surface thereof to be bent are arranged between opposite rotating units in a width direction or an advancing direction of the workpiece or both directions thereof.

11. The forming machine according to claim 7, wherein a support roll train in which when a plurality of support rolls which are abutted onto the width's center of the workpiece from an outer surface thereof to be bent are arranged, the rolls being supported in roll holders connected to be a conveyor belt, the rolls between the rotating units are conveyable to both downstream and upstream sides of the workpiece, and a roll caliber curvature radius of the rolls is sequentially smaller from the downstream side to the upstream side, is arranged between the opposite rotating units, and is selected by moving a position of the conveyor belt.

12. The forming machine according to claim 7, wherein one or more support rolls which are abutted onto the workpiece which has just exited from the forming segment, from an outer surface thereof to be bent are arranged in a circumferential direction or an advancing direction of the workpiece or both directions thereof.

* * * * *